US012753980B2

(12) United States Patent
Tanaka

(10) Patent No.: US 12,753,980 B2
(45) Date of Patent: Oct. 6, 2026

(54) GAS COOLER

(71) Applicant: KOBELCO COMPRESSORS CORPORATION, Tokyo (JP)

(72) Inventor: Junya Tanaka, Kako-gun (JP)

(73) Assignee: KOBELCO COMPRESSORS CORPORATION, Tokyo (JP)

( * ) Notice: Subject to any disclaimer, the term of this patent is extended or adjusted under 35 U.S.C. 154(b) by 53 days.

(21) Appl. No.: 18/569,544

(22) PCT Filed: Jun. 8, 2022

(86) PCT No.: PCT/JP2022/023063

§ 371 (c)(1),
(2) Date: Dec. 12, 2023

(87) PCT Pub. No.: WO2023/276590

PCT Pub. Date: Jan. 5, 2023

(65) Prior Publication Data

US 2024/0280336 A1 Aug. 22, 2024

(30) Foreign Application Priority Data

Jun. 30, 2021 (JP) ..... 2021-109505

(51) Int. Cl.
*F28F 17/00* (2006.01)

(52) U.S. Cl.
CPC ..... *F28F 17/005* (2013.01)

(58) Field of Classification Search
CPC ..... F28F 17/005; F04D 29/5833
See application file for complete search history.

(56) References Cited

U.S. PATENT DOCUMENTS 5,386,873 A * 2/1995 Harden, III ..... F04D 29/5833 165/47
2003/0059299 A1 3/2003 Miura et al.
2017/0167797 A1* 6/2017 Tomioka ..... F28D 7/16
2018/0195817 A1* 7/2018 Uhland ..... F28F 17/005
2019/0226775 A1* 7/2019 Lorang ..... F24F 1/02
2019/0366805 A1* 12/2019 Kominami ..... F28F 9/0243
2022/0025811 A1* 1/2022 Fagerstrom ..... F28F 9/0265

FOREIGN PATENT DOCUMENTS

JP 05079791 A * 3/1993
JP H05-079791 A 3/1993
JP 2015-200474 A 11/2015
KR 10-2003-0026202 A 3/2003

OTHER PUBLICATIONS

International Preliminary Report On Patentability and Written Opinion issued in PCT/JP2022/023063; mailed Jan. 11, 2024.
International Search Report issued in PCT/JP2022/023063; mailed Jul. 12, 2022.

* cited by examiner

*Primary Examiner* — Devon Lane
(74) *Attorney, Agent, or Firm* — Studebaker Brackett PLLC

(57) ABSTRACT

A gas cooler includes drain recovery portions which are recesses locally provided in a bottom wall defining downstream spaces of a casing, and in which drain separated from gas by cooling the gas in cooling units is accumulated. The gas cooler includes drain discharge ports which are openings provided to penetrate a wall portion of the casing, and which are for guiding the drain accumulated in the drain recovery portions to an outside.

10 Claims, 12 Drawing Sheets

GAS COOLER

CROSS-REFERENCE TO RELATED APPLICATIONS

This is a national phase application in the United States of International Patent Application No. PCT/JP2022/023063 with an international filing date of Jun. 8, 2022, which claims priority of Japanese Patent Application No. 2021-109505 filed on Jun. 30, 2021 the contents of which are incorporated herein by reference.

TECHNICAL FIELD

The present invention relates to a gas cooler.

BACKGROUND ART

In the compressor gas cooler disclosed in JP 2015-200474 A, the gas introduced from the gas inlet to the inside is cooled by passing through the heat exchanger from the upper side to the lower side, and is led out from the gas outlet. Liquid (moisture when the gas is air) in the gas condensed by cooling, that is, the drain is recovered in a drain recovery portion provided in a bottom wall of the gas cooler. The drain recovered in the drain recovery portion is discharged to the outside from an opening (drain discharge port) provided in a casing of the gas cooler.

SUMMARY OF THE INVENTION

Problems to be Solved by the Invention

In the gas cooler of JP 2015-200474 A, the gas flowing toward the gas outlet is likely to leak from the drain discharge port together with the drain at the time of drain discharge. In particular, when the liquid level of the drain accumulated in the drain recovery portion is low, the gas leaks out from the drain discharge port in such a mode as to push aside the drain. When gas leaks from the drain outlet, the drain amount that can be discharged from the drain discharge port decreases accordingly. That is, the leakage of the gas from the drain outlet reduces drain discharge performance.

An object of the present invention is to improve drain discharge performance of a gas cooler.

Solutions to the Problems

An aspect of the present invention provides a gas cooler including: a casing provided with a gas inlet and a gas outlet; a cooling unit provided inside the casing, the cooling unit being configured to divide the inside of the casing into an upstream space to which the gas inlet opens and a downstream space to which the gas outlet opens, the cooling unit being configured to cool gas introduced into the inside of the casing; a drain recovery portion being a recess locally provided in a bottom wall defining the downstream space of the casing, the drain recovery portion being configured to accumulate drain separated from the gas by cooling the gas in the cooling unit; and a drain discharge port being an opening provided to penetrate a wall portion of the casing, the drain discharge port being configured to guide the drain accumulated in the drain recovery portion to an outside of the casing.

Since the drain recovery portions are recesses locally provided in the bottom wall of the casing, even when the liquid amount of drain is relatively small, a state in which the liquid level of the drain in the drain recovery portions is high, and the drain discharge ports are below the liquid level of the drain can be maintained. As a result, it is possible to prevent or suppress gas leaking out from the drain discharge ports in a mode such as pushing aside the drain. By preventing or suppressing the leakage of the gas from the drain outlet, it is possible to avoid a decrease in the drain amount that can be discharged from the drain discharge ports due to the leakage of the gas, and to improve the drain discharge performance.

A peripheral wall of the drain recovery portion may be cast to be a wall different from a peripheral wall defining the downstream space of the casing.

With this configuration, local recesses of the drain recovery portions can be easily formed, and drain discharge performance can be improved as described above. That is, in order to improve the drain discharge performance, increase in the number of parts and complication of the structure are not caused.

A width being a dimension in a direction orthogonal to a direction toward the drain discharge port of the drain recovery portion may be 0.2 times or more and 0.5 times or less a width being a dimension in a direction orthogonal to a direction toward the drain discharge port of the downstream space.

The bottom wall of the casing may have a first inclination downward toward the drain recovery portion. A bottom wall of the drain recovery portion may have a second inclination downward toward the drain discharge port. The second inclination may be larger than the first inclination.

With this configuration, the drain can be easily collected to the drain recovery portion by the first inclination, and since the drain discharge port can be easily sealed with the drain while suppressing the increase in the height of the casing by the second inclination, the drain discharge performance can be improved.

A height position of an upper end of the drain discharge port may be lower than a height position of an upper end of the drain recovery portion.

With this configuration, even when the liquid level of the drain in the drain recovery portions is relatively low, it is possible to prevent or suppress the gas leaking out from the drain discharge ports, and the drain discharge performance is improved.

An ascending flow path extending upward from the gas outlet may be formed in the casing. The drain recovery portion may be provided to face a lower end of the ascending flow path.

With this configuration, the distance between the gas flow ascending through the ascending flow path and the liquid level of the drain can be increased, and the drain leaking out together with the gas flow can be prevented or suppressed.

The drain recovery portion may locally protrude from the casing in appearance.

With this configuration, it is possible to minimize an increase in size of the casing due to the provision of the drain recovery portions and an increase in weight associated therewith.

Effects of the Invention

According to the present invention, drain discharge performance of a gas cooler can be improved without increasing the number of parts and complicating the structure.

DETAILED DESCRIPTION

Figure 1:
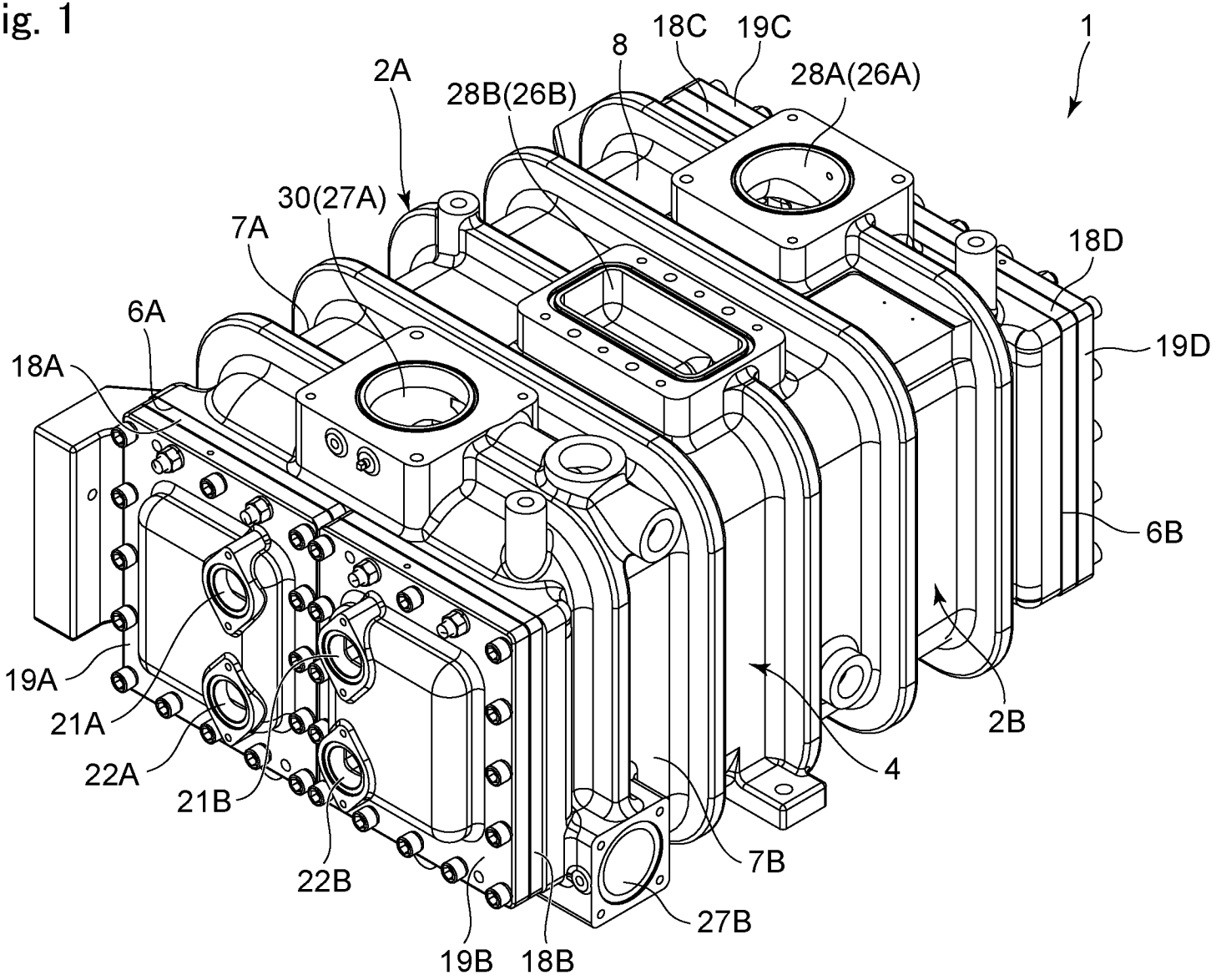
FIG. 1 is a perspective view of a gas cooler according to an embodiment of the present invention.
Figure 2:
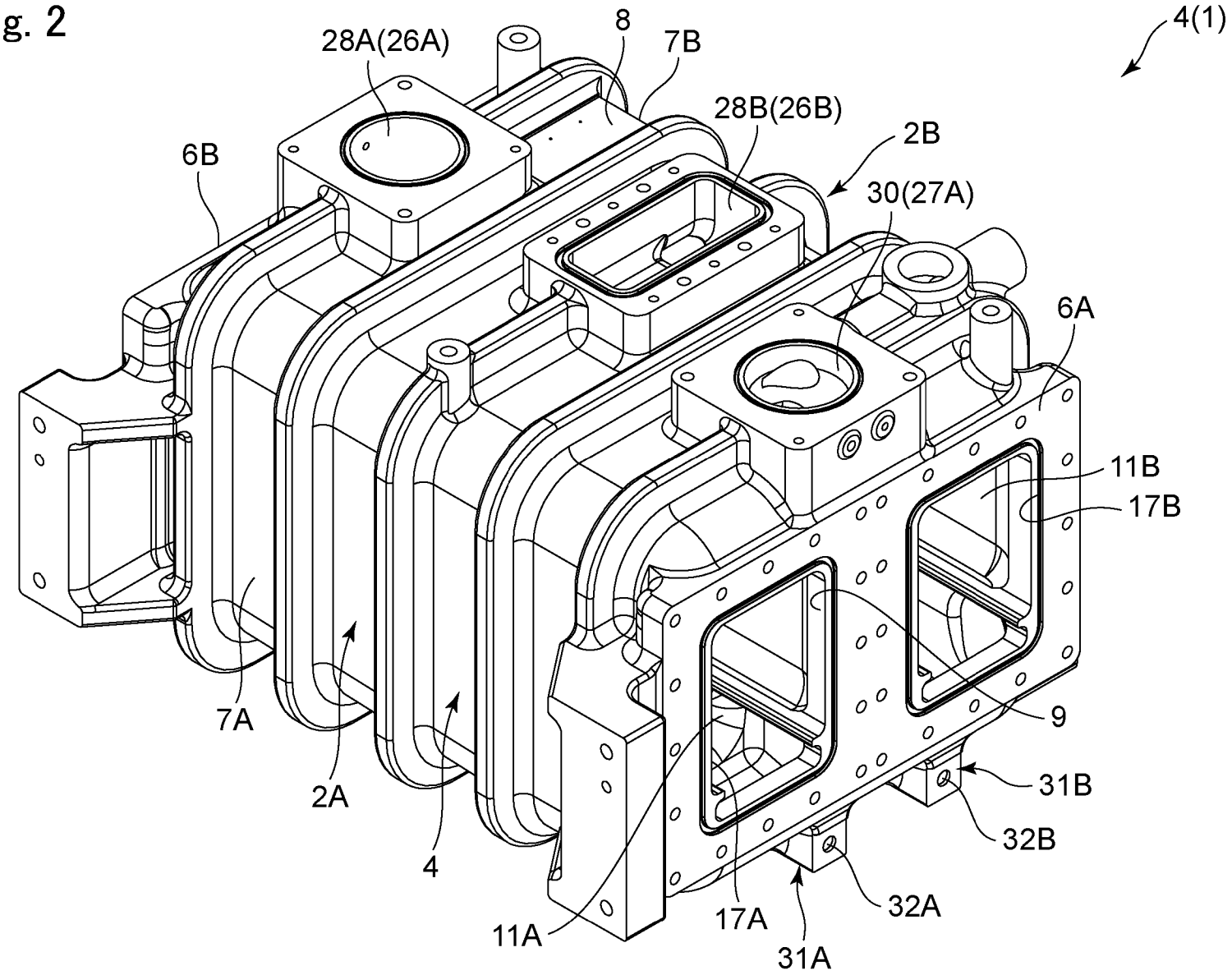
FIG. 2 is a perspective view of a casing as viewed from above.

Referring to FIGS. 1 to 5, a gas cooler 1 according to an embodiment of the present invention includes a casing 4 which includes an intercooler 2A and an aftercooler 2B and in which the intercooler 2A and the aftercooler 2B are integrated. In the present embodiment, the gas cooler 1 is incorporated into an oil-free two-stage screw compressor. The intercooler 2A is provided in the gas flow path between the low-stage side screw compressor and the high-stage side screw compressor, and the aftercooler 2B is provided in the gas flow path downstream of the high-stage side screw compressor.

Referring also to FIGS. 6 to 9, the casing 4 includes a bottom wall 5, a pair of end walls 6A and 6B rising from the bottom wall 5, a pair of side walls 7A and 7B rising from the bottom wall 5, a top wall 8 at upper ends of the end walls 6A and 6B and the side walls 7A and 7B, and a partition wall 9. The partition wall 9 partitions the inside of the casing 4, that is, a space surrounded by the bottom wall 5, the end walls 6A and 6B, the side walls 7A and 7B, and the top wall 8 into a first space 11A for the intercooler 2A and a second space 11B for the aftercooler 2B. In the present embodiment, the casing 4 is manufactured by casting.

Referring to FIGS. 6 to 9, the heat exchanger (cooling unit) 12A of the intercooler 2A is housed in the first space 11A, and the heat exchanger (cooling unit) 12B of the aftercooler 2B is housed in the second space 11B. Each of the heat exchangers 12A and 12B includes a pair of seal plates 14 and 14 connected by a spacer 13 and a tube nest 15 disposed between the seal plates 14 and 14. In addition, each of the heat exchangers 12A and 12B includes a large number of fins 16 arranged at intervals, and the tube nest 15 is integrated with these fins 16.

Referring to FIGS. 6 to 9, the one end wall 6A of the casing 4 is provided with an opening 17A for the heat exchanger 12A of the intercooler 2A and an opening 17B for the heat exchanger 12B of the aftercooler 2B. In addition, the other end wall 6B of the casing 4 is also provided with an opening 17C for the heat exchanger 12A of the intercooler 2A and an opening 17D for the heat exchanger 12B of the aftercooler 2B. The heat exchanger 12A of the intercooler 2A is disposed in an attitude extending in the horizontal direction into the first space 11A by being inserted into the openings 17A and 17C. Similarly, the heat exchanger 12B of the aftercooler 2B is disposed in an attitude extending in the horizontal direction into the second space 11B by being inserted into the openings 17B and 17D. Referring also to FIG. 1, the openings 17A and 17B are sealed in an airtight state by the attachment portions 18A and 18B, and the covers 19A and 19B are attached to the attachment portions 18A and 18B. In addition, the openings 17C and 17D are sealed in an airtight state by the attachment portions 18C and 18D, and the covers 19C and 19D are attached to the attachment portions 18C and 18D.

Referring to FIG. 1, the cooling water is supplied from the inflow port 21A provided in the cover 19A to the tube nest 15 of the heat exchanger 12A of the intercooler 2A, and the cooling water having passed through the tube nest 15 flows out from the outflow port 22A provided in the cover 19A. In addition, the cooling water is supplied from the inflow port 21B provided in the cover 19B to the tube nest 15 of the heat exchanger 12B of the aftercooler 2B, and the cooling water having passed through the cooling pipe 17 flows out from the outflow port 22B provided in the cover 19B.

Figure 8:
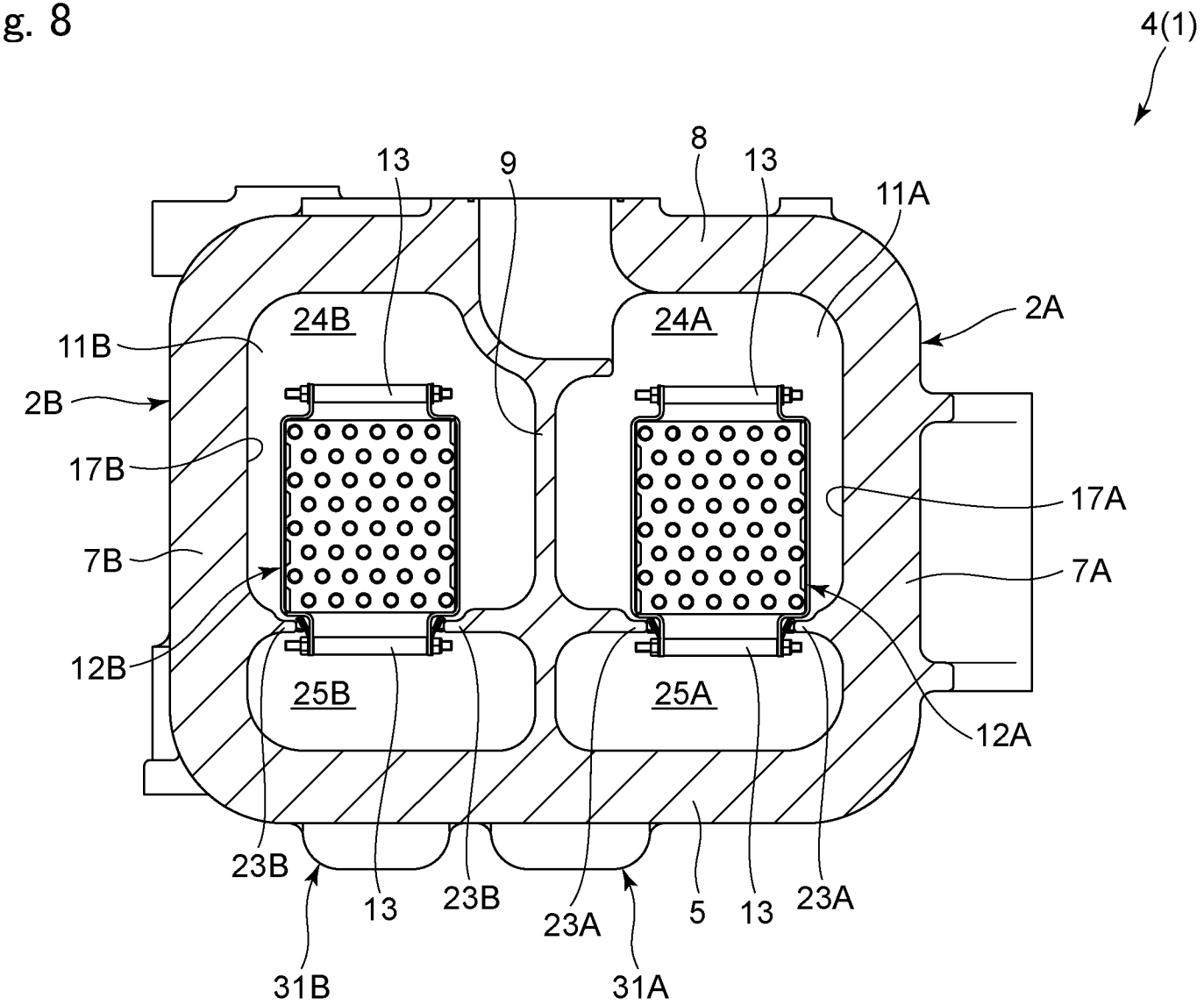
FIG. 8 is a cross-sectional view of the casing taken along line VIII-VIII in FIG. 5.
Figure 9:
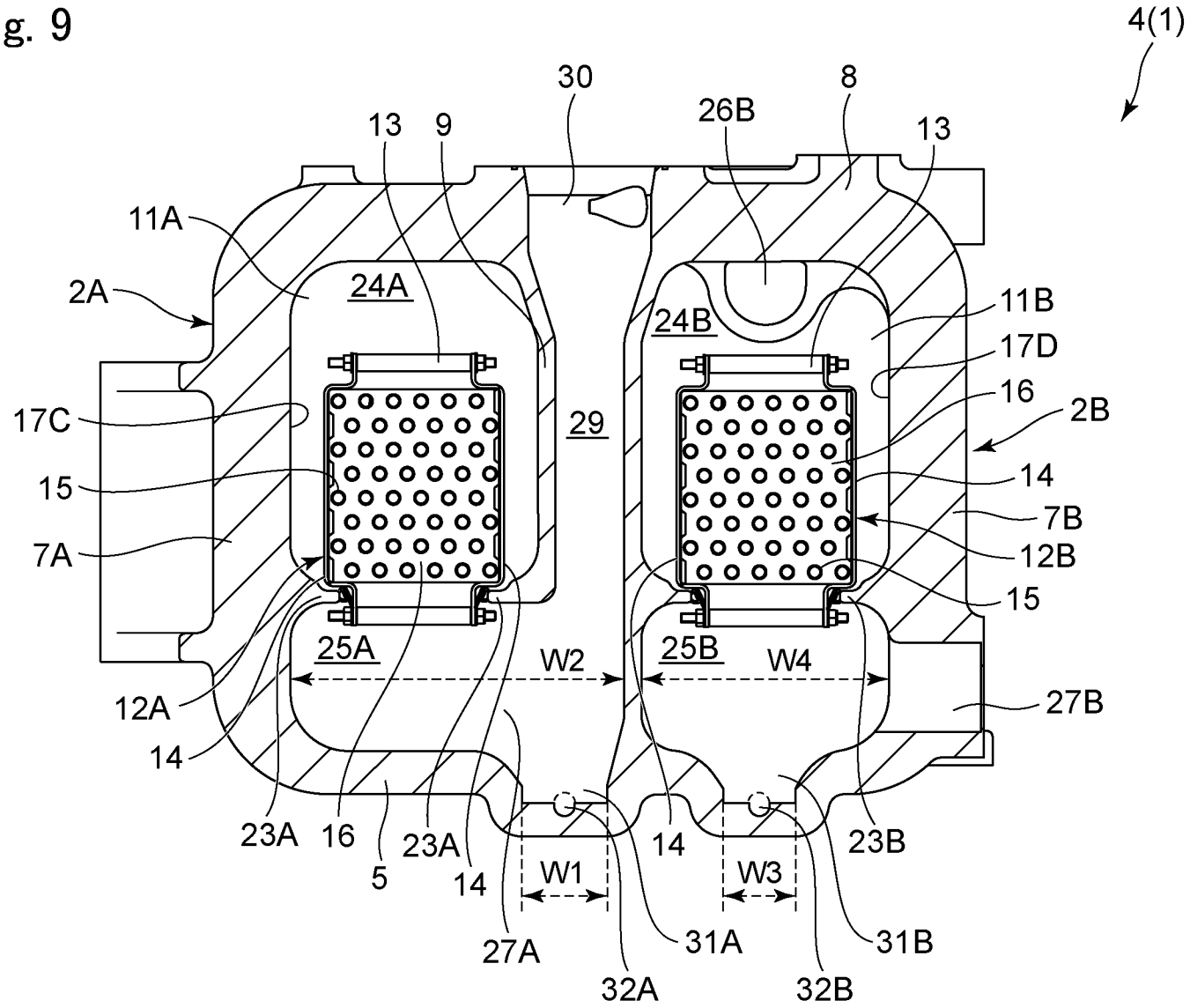
FIG. 9 is a cross-sectional view of the casing taken along line IX-IX in FIG. 5.

Referring to FIGS. 8 and 9, in the first space 11A, a pair of support ribs 23A and 23A extending between the end walls 6A and 6B is provided on the side wall 7A and the partition wall 9. The seal plates 14 and 14 of the heat exchanger 12A of the intercooler 2A are supported on the support ribs 23A and 23A, and a seal portion is formed. Therefore, over between the end walls 6A and 6B, the first space 11A is partitioned into an upstream space 24A above the heat exchanger 12A and a downstream space 25A below the heat exchanger 12A.

Similarly, in the second space 11B, the seal plates 14 and 14 of the heat exchanger 12B of the aftercooler 2B are supported on the support ribs 23B and 23B provided on the side wall 7B and the partition wall 9, and a seal portion is formed. Therefore, over between the end walls 6A and 6B, the second space 11B is partitioned into an upstream space 24B above the heat exchanger 12B and a downstream space 25B below the heat exchanger 12B.

Figure 6:
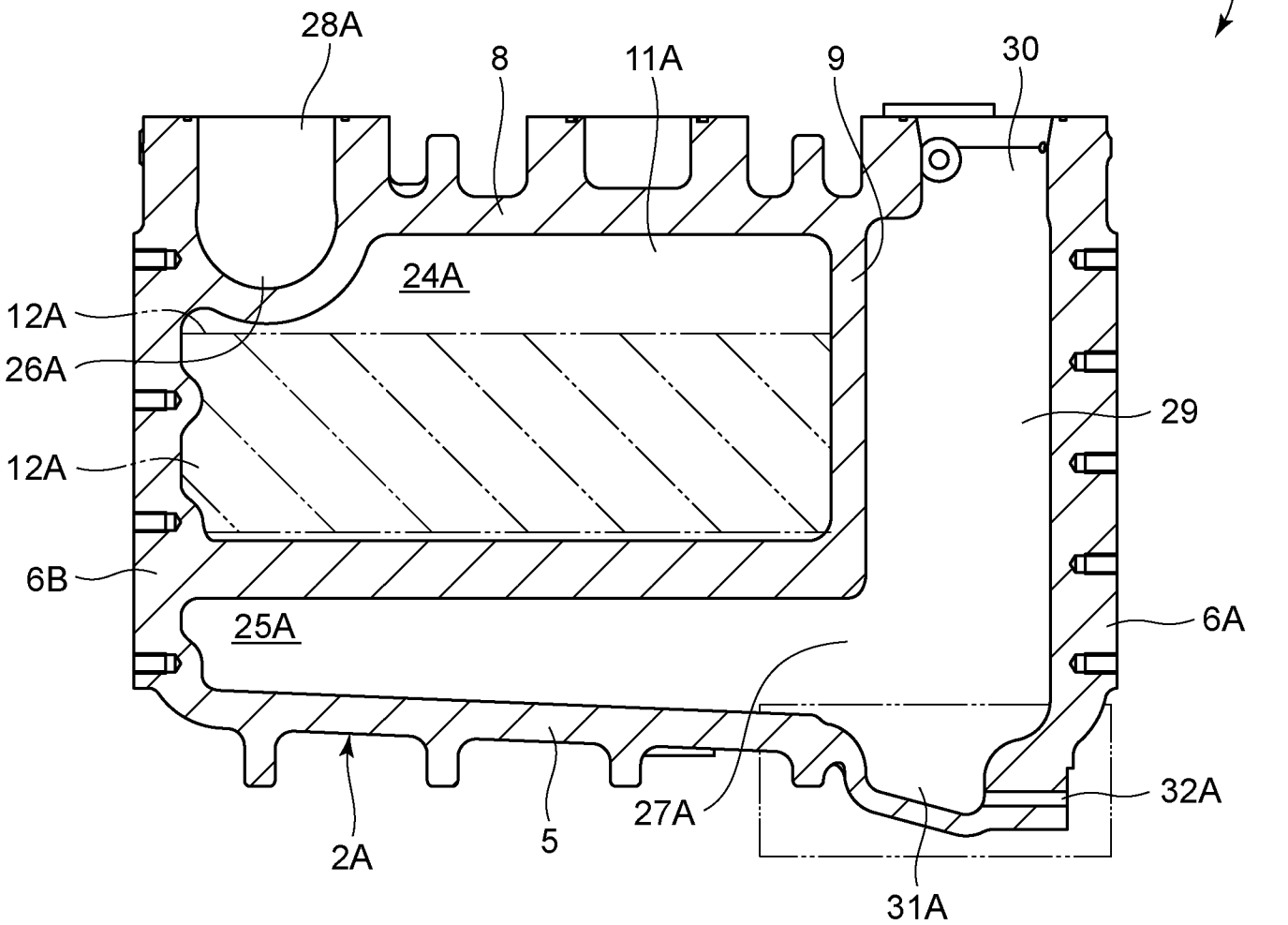
FIG. 6 is a cross-sectional view of the casing taken along line VI-VI in FIG. 4.

Referring to FIG. 6, the top wall 8 of the casing 4 is provided with a gas inlet 26A of the intercooler 2A so as to open to the upstream space 24A. The gas inlet 26A communicates with an inlet port 28A (see FIGS. 1 and 2) fluidly connected to an exhaust port of the low-stage side screw compressor. In addition, the partition wall 9 of the casing 4 is provided with a gas outlet 27A of the intercooler 2A so as to open to the downstream space 25A. In addition, the partition wall 9 of the casing 4 is formed with an ascending flow path 29 extending upward from the gas outlet 27A, and the gas outlet 27A communicates with an outlet port 30 (see FIGS. 1 and 2) provided in the top wall 7 through the ascending flow path 29. The outlet port 30 is fluidly connected to a suction port of the high-stage side screw compressor.

Figure 7:
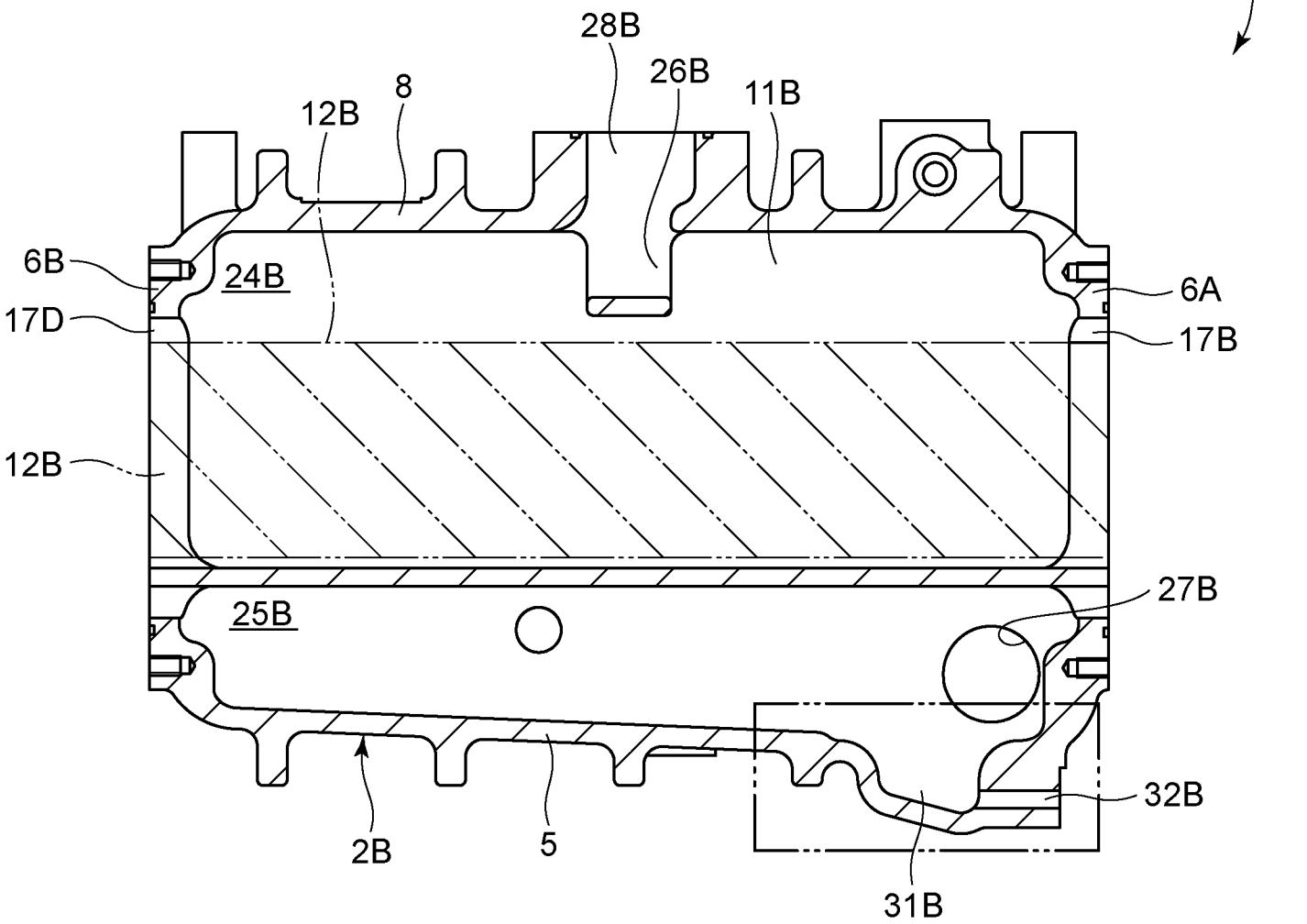
FIG. 7 is a cross-sectional view of the casing taken along line VII-VII in FIG. 4.

Referring to FIG. 7, the top wall 8 of the casing 4 is provided with a gas inlet 26B of the aftercooler 2B so as to open to the upstream space 24B. The gas inlet 26B communicates with an inlet port 28B (see FIGS. 1 to 3) fluidly connected to an exhaust port of the high-stage side screw compressor. In addition, the side wall 7B is provided with a gas outlet 27B of the aftercooler 2B so as to open to the downstream space 25B. The gas outlet 27B is fluidly connected downstream of the two-stage screw compressor.

The gas (for example, compressed air) exhausted from the exhaust port of the low-stage side screw compressor is introduced into the intercooler 2A. Specifically, the gas exhausted from the exhaust port of the low-stage side screw compressor is introduced from the gas inlet 26A into the upstream space 24A of the intercooler 2A through the inlet port 28A, passes through the heat exchanger 12A from the upper side to the lower side, and flows into the downstream space 25A. The gas flowing into the downstream space 25A flows from the gas outlet 27A to the ascending flow path 29 and is led out from the outlet port 30. The gas led out from the intercooler 2A is sucked into the suction port of the high-stage side screw compressor.

The gas exhausted from the exhaust port of the high-stage side screw compressor is introduced into the aftercooler 2B. Specifically, the gas exhausted from the exhaust port of the high-stage side screw compressor is introduced from the gas inlet 26B into the upstream space 24B of the aftercooler 2B through the inlet port 28B, passes through the heat exchanger 12B from the upper side to the lower side, and flows into the downstream space 25B. The gas flowing into the downstream space 25B is led out from the gas outlet 27B and sent to the downstream side.

In the heat exchanger 12A of the intercooler 2A and the heat exchanger 12B of the aftercooler 2B, the gas comes into contact with the tube nest 15 and the fins 16, thereby exchanging heat with the cooling water in the tube nest 16 to be cooled. The liquid components in the cooled gas are condensed to form droplets and fall to form drain.

Figure 12:
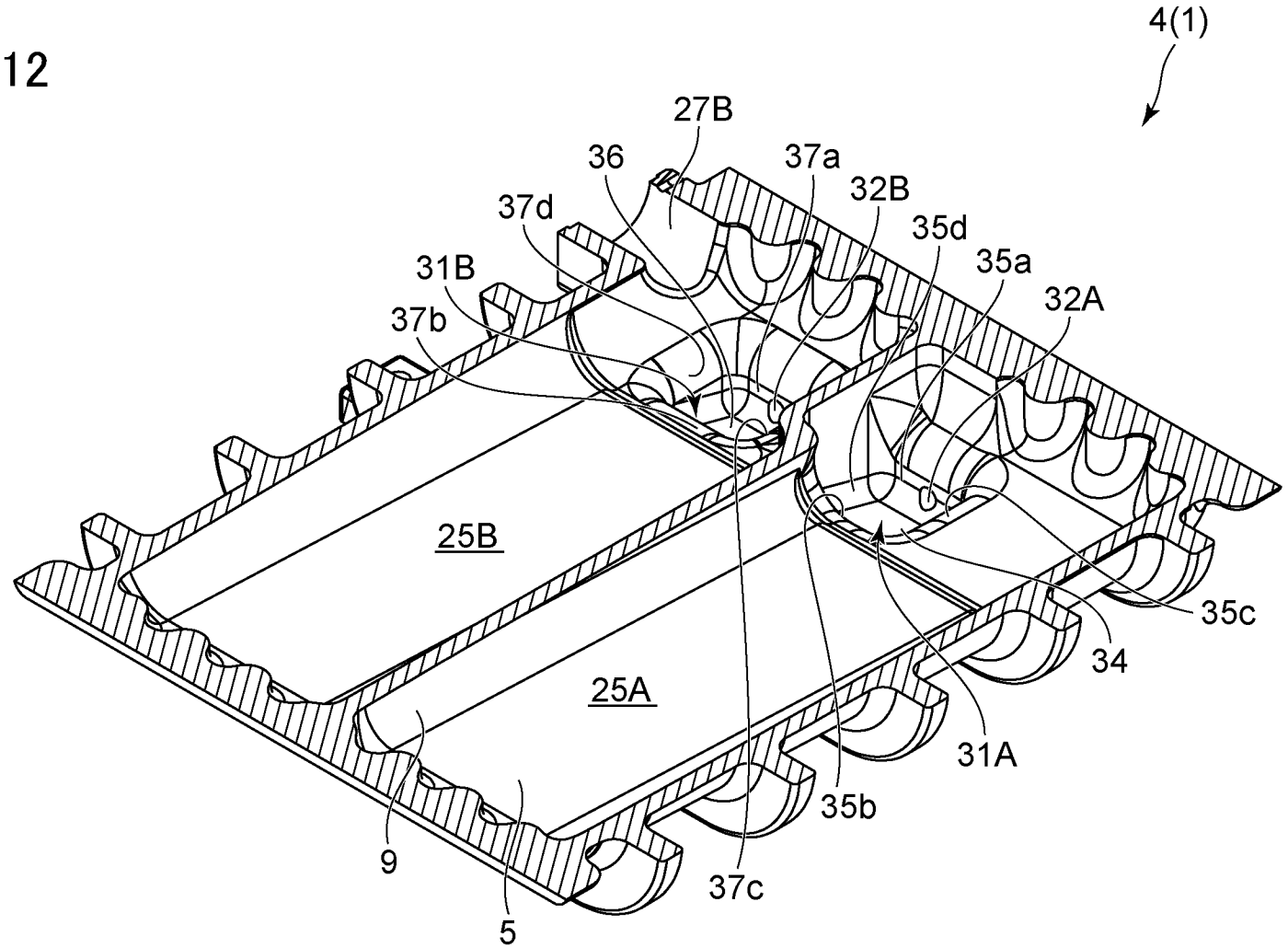
FIG. 12 is a cross-sectional view of the casing taken along line XII-XII in FIG. 5.
Figure 13:
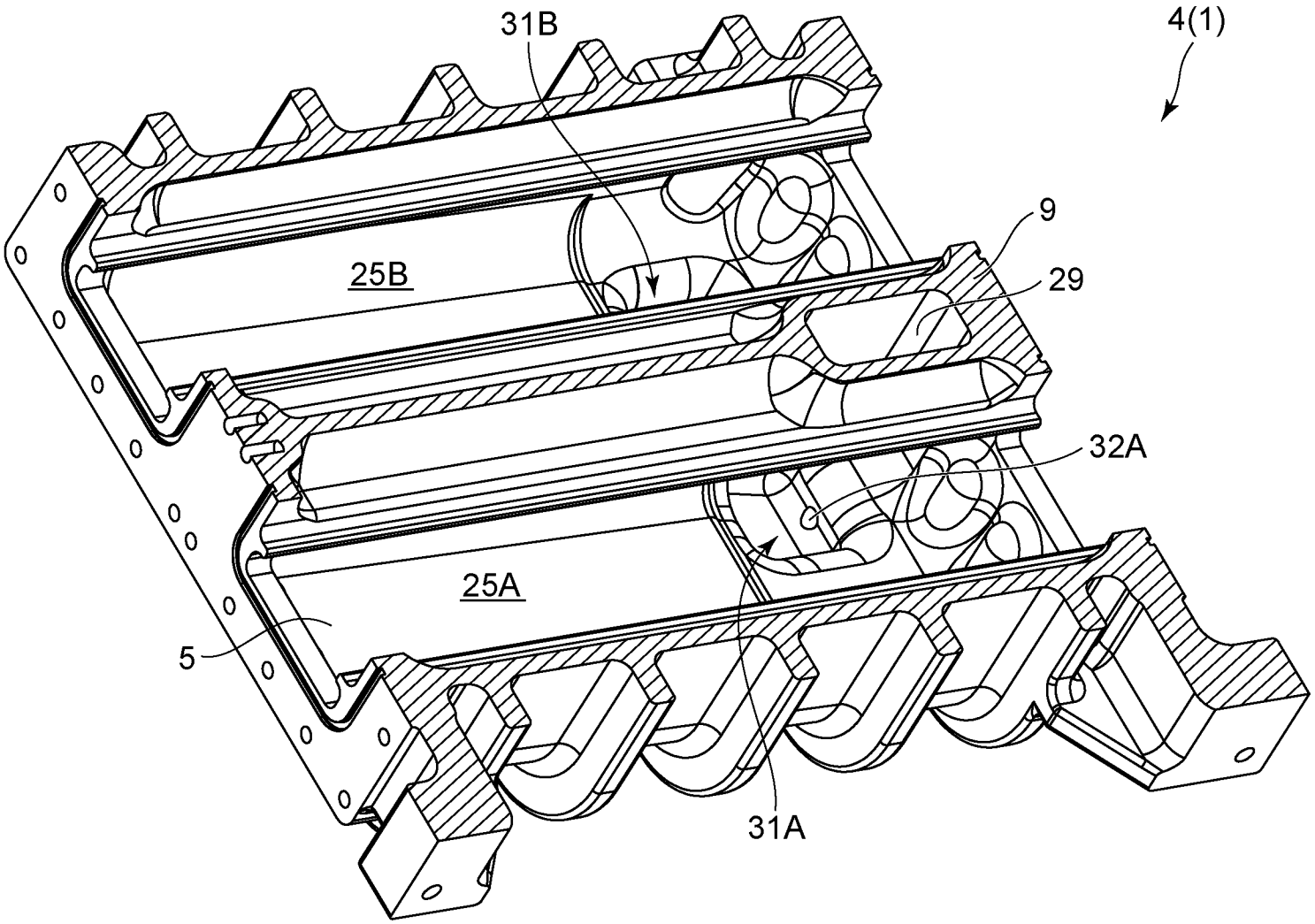
FIG. 13 is a cross-sectional view of the casing taken along line XIII-XIII in FIG. 5.

As shown most clearly in FIGS. 12 and 13, a drain recovery portion 31A being a local recess is provided in a portion defining the downstream space 25A of the intercooler 2A of the bottom wall 5. In addition, a drain recovery portion 31B being is a local recess is provided in a portion defining the downstream space 25B of the aftercooler 2B of the bottom wall 5.

Figure 3:
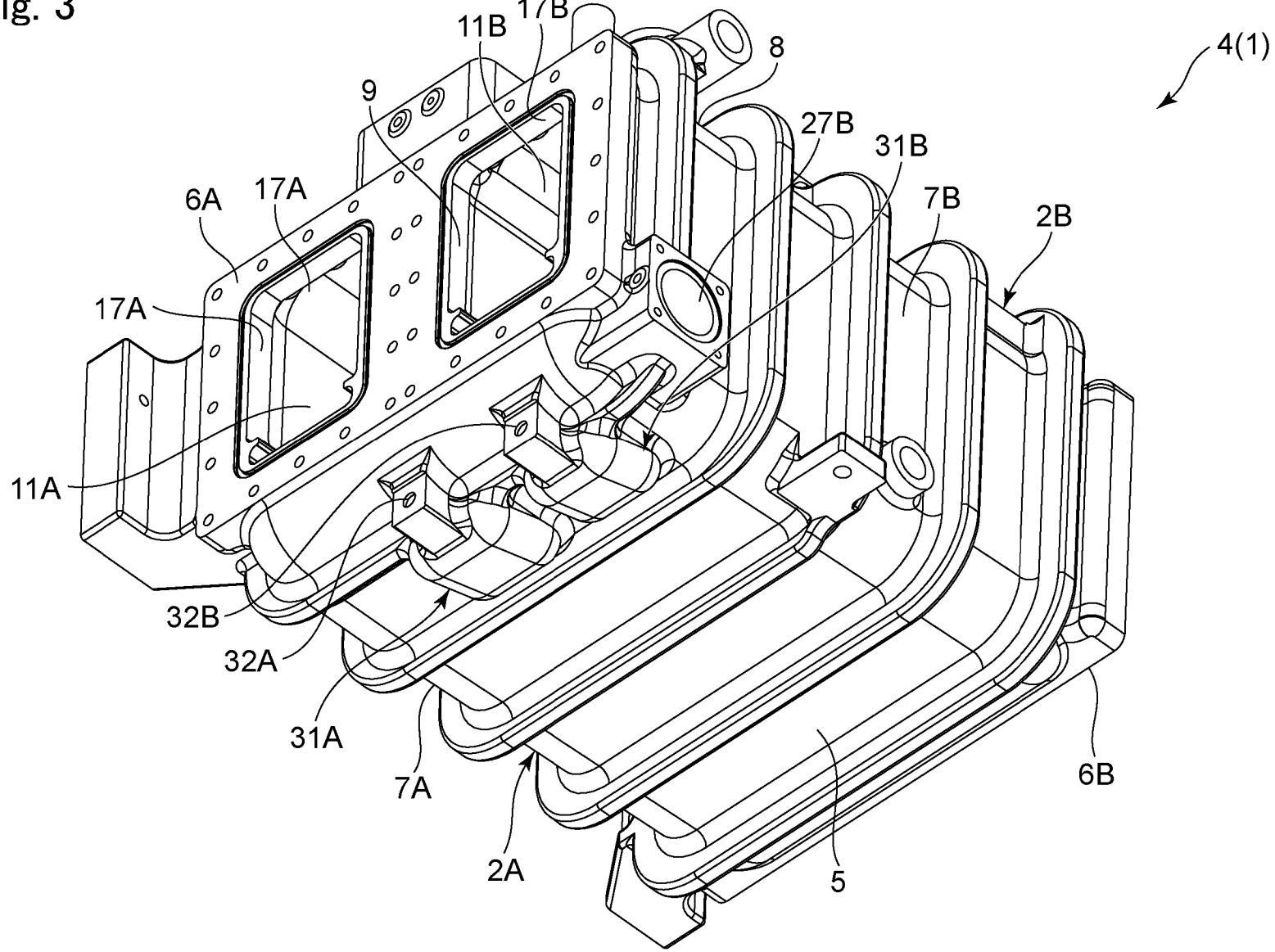
FIG. 3 is a perspective view of the casing as viewed from below.
Figure 4:
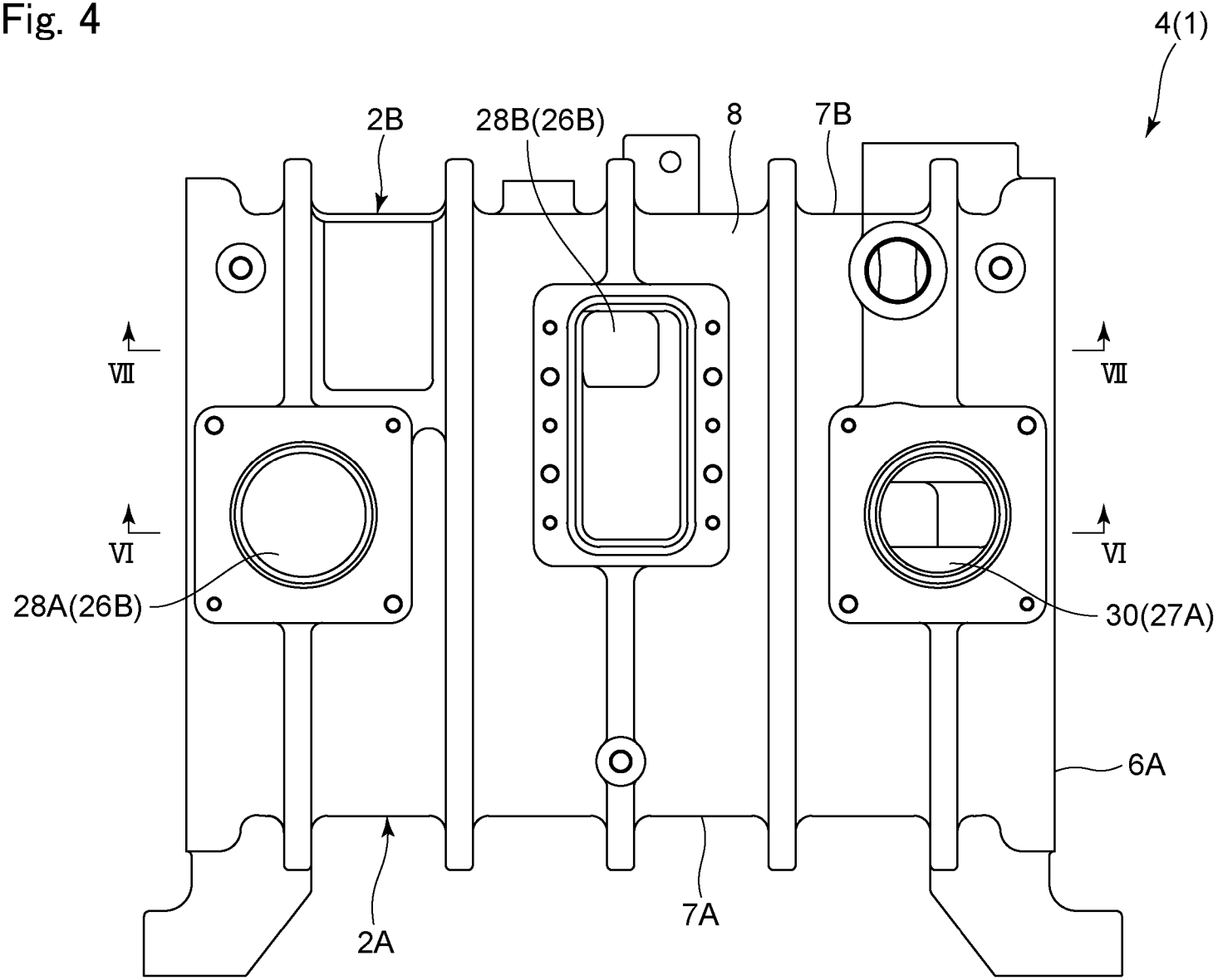
FIG. 4 is a plan view of the casing.
Figure 5:
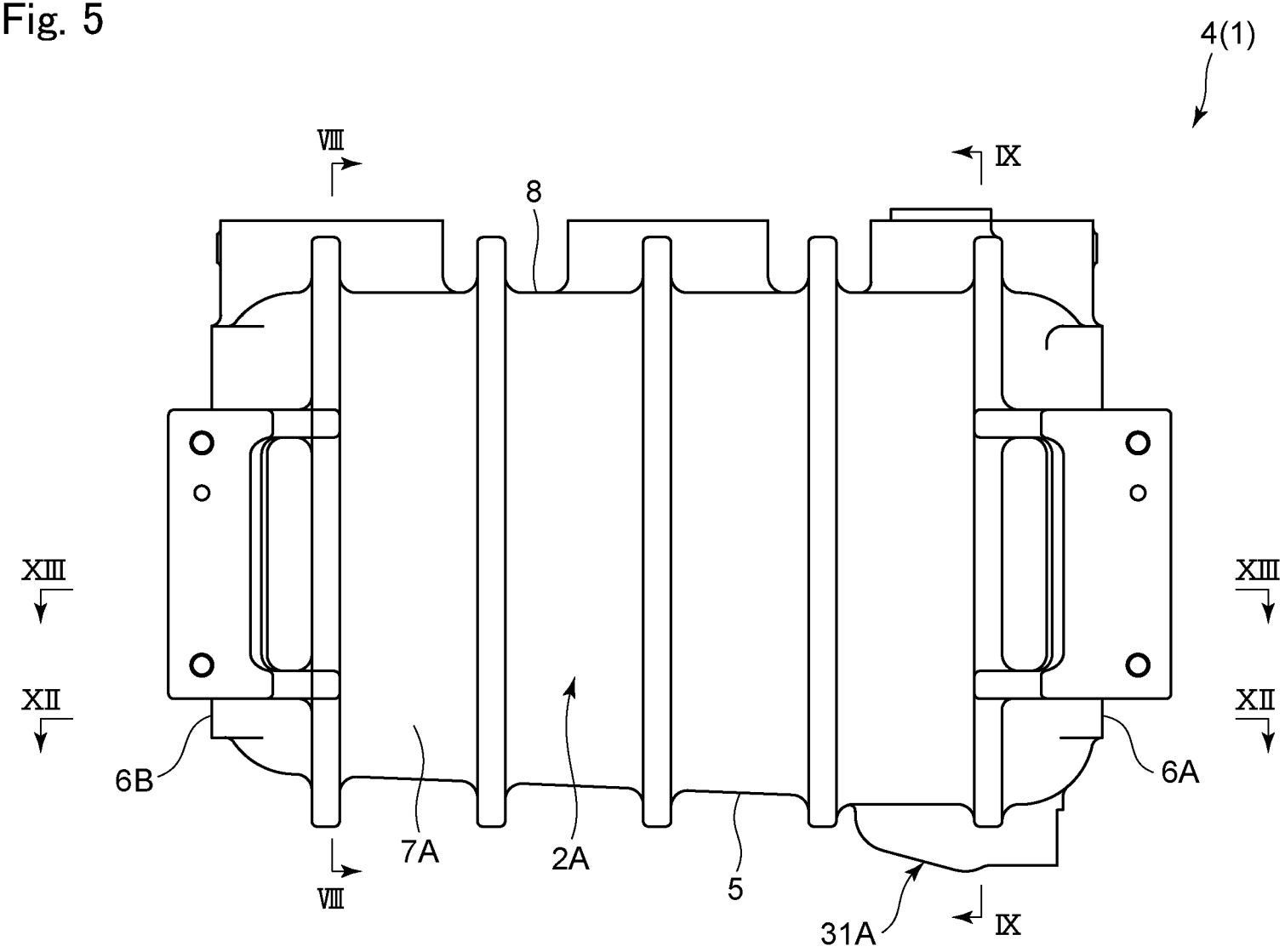
FIG. 5 is a front view of the casing.

As shown most clearly in FIG. 3, in the appearance of the gas cooler 1, the drain recovery portions 31A and 31B locally protrude from the bottom wall 5 of the casing 4.

Figure 10:
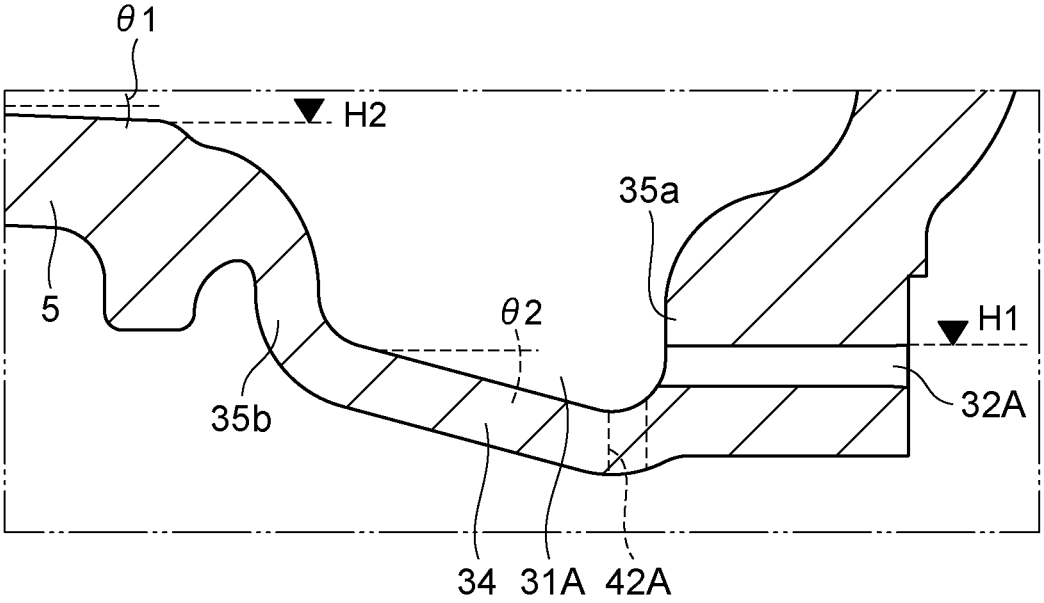
FIG. 10 is an enlarged view of a portion X in FIG. 6.

Referring also to FIGS. 7 and 10, the intercooler 2A is provided with a drain discharge port 32A which is an opening penetrating the end wall 6A of the casing 4 and communicating with the drain recovery portion 31A. The upper surface of the portion defining the downstream space 25A of the intercooler 2A of the bottom wall 5 has a downward inclination θ1 (first inclination) toward the drain recovery portion 31A. Therefore, the drain separated from the gas by cooling the gas in the heat exchanger 12A flows on the upper surface of the bottom wall 5 toward the drain recovery portion 31A, and is captured and accumulated in the drain recovery portion 31A. The drain accumulated in the drain recovery portion 31A is discharged from the drain discharge port 32A to the outside of the casing 4 by opening an electromagnetic valve (not shown) provided outside the casing 4 downstream of the drain discharge port 32A.

Figure 11:
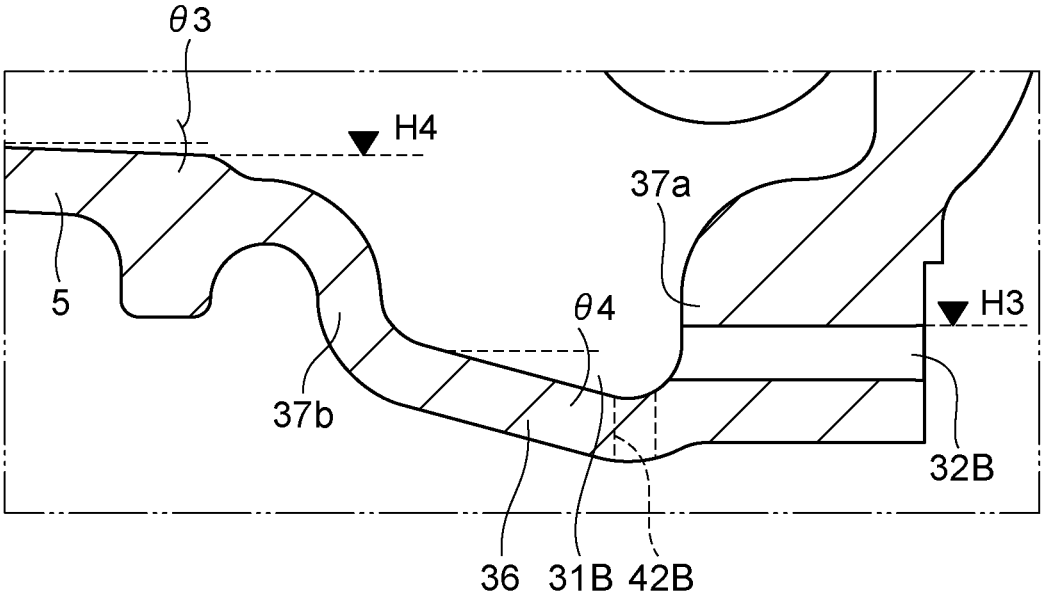
FIG. 11 is an enlarged view of a portion XI in FIG. 7.

Referring also to FIGS. 8 and 11, also the aftercooler 2B is provided with a drain discharge port 32B which is an opening penetrating the end wall 6A of the casing 4 and communicating with the drain recovery portion 31B. The upper surface of the portion defining the downstream space 25B of the aftercooler 2B of the bottom wall 5 has a downward inclination θ3 (first inclination) toward the drain recovery portion 31B. Therefore, the drain separated from the gas by cooling the gas in the heat exchanger 12B flows on the upper surface of the bottom wall 5 toward the drain recovery portion 31B, and is captured and accumulated in the drain recovery portion 31B. The drain accumulated in the drain recovery portion 31B is discharged from the drain discharge port 32A to the outside of the casing 4 by opening an electromagnetic valve (not shown) provided outside the casing 4 downstream of the drain discharge port 32B.

Referring to FIGS. 6, 10, 12, and 13, the drain recovery portion 31A of the intercooler 2A is defined by the peripheral wall, that is, the bottom wall 34 and the four side walls 35*a*, 35*b*, 35*c*, and 35*d*. The drain discharge port 32A is opened in the side wall 35*a* positioned on the end wall 6A side. An upper surface of the bottom wall 34 of the drain recovery portion 31A has a downward inclination θ2 (second inclination) toward the drain discharge port 32A. The inclination θ2 is larger than the downward inclination θ1 (first inclination) of the upper surface of the portion defining the downstream space 25A of the intercooler 2A of the bottom wall 5 described above.

Referring to FIGS. 7, 11, 12, and 13, the drain recovery portion 31B of the aftercooler 2B is defined by the peripheral wall, that is, the bottom wall 36 and the four side walls 37*a*, 37*b*, 37*c*, and 37*d*. The drain discharge port 32B is opened in the side wall 37*a* positioned on the end wall 6A side. An upper surface of the bottom wall 36 of the drain recovery portion 31B has a downward inclination θ4 (second inclination) toward the drain discharge port 32A. The inclination θ4 is larger than the downward inclination θ3 of the upper surface of the portion defining the downstream space 25B of the aftercooler 2B of the bottom wall 5 described above.

Referring to FIG. 9, in the intercooler 2A, a width W1 being a dimension in a direction orthogonal to the direction toward the drain discharge port 32A of the drain recovery portion 31A is 0.2 times or more and 0.5 times or less a width W2 being a dimension in a direction orthogonal to the direction toward also the drain discharge port 32A of the downstream space 24A. In addition, also in the aftercooler 2B, the width W3 of the drain recovery portion 31B is 0.2 times or more and 0.5 times or less the width W4 of the downstream space 24B.

Referring to FIG. 10, in the intercooler 2A, the height position H1 of the upper end of the drain discharge port 32A is lower than the height position H2 of the upper end of the drain recovery portion 31A. Referring to FIG. 11, also in the aftercooler 2B, the height position H3 of the upper end of the drain discharge port 32B is lower than the height position H4 of the upper end of the drain recovery portion 31B.

Referring to FIG. 6, in the intercooler 2A, the drain recovery portion 31A is provided so as to face the lower end of the ascending flow path 29.

Since the drain recovery portions 31A and 31B are recesses locally provided in the bottom wall 5 of the casing 4, even when the liquid amount of drain is relatively small, a state in which the liquid level of the drain in the drain recovery portions 31A and 31B is high, and the drain discharge ports 32A and 32B are below the liquid level of the drain can be maintained. As a result, it is possible to prevent or suppress gas leaking out from the drain discharge ports 32A and 32B in a mode such as pushing aside the drain at the time of drain discharge. By preventing or suppressing the leakage of the gas from the drain discharge ports 32A and 32B, it is possible to avoid a decrease in the drain amount that can be discharged from the drain discharge ports 32A and 32B due to the leakage of the gas, and to improve the drain discharge performance.

The drain recovery portion 31A is a recess locally provided in the bottom wall 5 of the casing 4, and the peripheral wall of the drain recovery portion 31A, that is, the bottom wall 34 and the four side walls 35*a* to 35*d* are cast as a peripheral wall defining the downstream space 25A, that is, walls different from the bottom wall 5, the end walls 6A and 6B, the side wall 7A, the top wall 8, and the partition wall 9 of the casing 4. Similarly, the drain recovery portion 31B is a recess locally provided in the bottom wall 5 of the casing 4, and the peripheral wall of the drain recovery portion 31B, that is, the bottom wall 36 and the four side walls 37*a* to 37*d* are cast as a peripheral wall defining the downstream space 25B, that is, walls different from the bottom wall 5, the end walls 6A and 6B, the side wall 7B, the top wall 8, and the partition wall 9 of the casing 4. Therefore, local recesses of the drain recovery portions 31A and 31B can be easily formed, and drain discharge performance can be improved as described above. That is, in order to improve the drain discharge performance, increase in the number of parts and complication of the structure are not caused.

As described above, the bottom walls 34 and 36 of the drain recovery portions 31A and 31B have downward inclinations θ2 and θ4 toward the drain discharge ports 32A and 32B. By the downward inclinations θ2 and θ4, the flow toward the drain discharge ports 32A and 32B of the drain in the drain recovery portions 31A and 31B is promoted. Therefore, the drain discharge performance from the drain discharge ports 32A and 32B is improved also by the inclination of the bottom walls 34 and 36.

As described above, the downward inclinations θ2 and θ4 of the bottom walls 34 and 36 of the drain recovery portions 31A and 31B are larger than the downward inclinations θ1 and θ3 of the bottom wall 5 of the casing 4. The setting of the inclinations makes the flow velocity of the drain toward the drain discharge ports 32A and 32B in the drain recovery portions 31A and 31B larger than the flow velocity of the drain on the bottom wall 5 of the casing 4. As a result, the downward inclinations θ1 and θ3 of the bottom wall 5 of the casing 4 of the drain recovery portions 31A and 31B make collection of the drain into the drain recovery portions 31A and 31B easier, and the downward inclinations θ2 and θ4 of the bottom walls 34 and 36 of the drain recovery portions 31A and 31B make sealing the drain discharge ports 32A and 32B by the drain easier while suppressing an increase in the height of the casing 4, and the drain discharge performance is improved also in this respect.

As described above, the height positions H1 and H3 of the upper ends of the drain discharge ports 32A and 32B are lower than the height positions H2 and H4 of the drain recovery portions 31A and 31B. Therefore, even when the liquid level of the drain in the drain recovery portions 31A and 31B is relatively low, the drain discharge ports 32A and 32B are maintained in a state of being entirely immersed in the drain. As a result, even when the liquid level of the drain in the drain recovery portions 31A and 31B is relatively low, it is possible to prevent or suppress the gas leaking out from the drain discharge ports 32A and 32B, and the drain discharge performance is improved.

As described above, in the intercooler 2A, the drain recovery portion 31A being a local recess is provided so as to face the lower end of the ascending flow path 29 extending upward from the gas outlet 27A to the outlet port 30. Therefore, the distance between the gas flow ascending through the ascending flow path 29 and the liquid level of the drain can be increased, and the drain leaking out from the intercooler 2A together with the gas flow can be prevented or suppressed.

As described above, in the appearance of the gas cooler 1, the drain recovery portions 31A and 31B locally protrude from the bottom wall 5 of the casing 4. Therefore, it is possible to minimize an increase in size of the casing 4 due to the provision of the drain recovery portions 31A and 31B and an increase in weight associated therewith.

As respectively indicated by reference numerals 42A and 42B in FIGS. 10 and 11, the drain discharge port may be an opening penetrating the bottom wall of the casing 4 and communicating with the drain recovery portions 31A and 31B.

The invention claimed is:

1. A gas cooler for a compressor, the gas cooler comprising:

a casing provided with a gas inlet and a gas outlet;

a cooling unit provided inside the casing, the cooling unit being configured to divide the inside of the casing into an upstream space, above the cooling unit, to which the gas inlet opens and a downstream space, below the cooling unit, to which the gas outlet opens, the cooling unit being configured to cool gas introduced into the inside of the casing by allowing the gas to pass through the cooling unit;

a drain recovery portion being a recess locally provided in a bottom wall defining the downstream space of the casing, the drain recovery portion being configured to accumulate drain separated from the gas by cooling the gas in the cooling unit; and a drain discharge port being an opening provided to penetrate a wall portion of the casing, the drain discharge port being configured to guide the drain accumulated in the drain recovery portion to an outside of the casing;

wherein an upper surface of a lowermost bottom wall of the drain recovery portion inclines downward away from the gas outlet and toward the drain discharge port;

wherein an ascending flow path extending upward from the gas outlet is formed in the casing, and wherein the drain recovery portion is directly below a lower end of the ascending flow path.

2. The gas cooler according to claim 1, wherein a peripheral wall of the drain recovery portion is cast to be a wall different from a peripheral wall defining the downstream space of the casing.

3. The gas cooler according to claim 1, wherein a width being a dimension in a direction orthogonal to a direction toward the drain discharge port of the drain recovery portion is 0.2 times or more and 0.5 times or less a width being a dimension in a direction orthogonal to a direction toward the drain discharge port of the downstream space.

4. The gas cooler according to claim 1, wherein the bottom wall of the casing has a first inclination downward toward the drain recovery portion, wherein the lowermost bottom wall of the drain recovery portion has a second inclination downward toward the drain discharge port, and wherein the second inclination is larger than the first inclination.

5. The gas cooler according to claim 1, wherein a height position of an upper end of the drain discharge port is lower than a height position of an upper end of the drain recovery portion.

6. The gas cooler according to claim 1, wherein the drain recovery portion locally protrudes from the casing in appearance.

7. The gas cooler according to claim 2, wherein a width being a dimension in a direction orthogonal to a direction toward the drain discharge port of the drain recovery portion is 0.2 times or more and 0.5 times or less a width being a dimension in a direction orthogonal to a direction toward the drain discharge port of the downstream space.

8. The gas cooler according to claim 2, wherein the bottom wall of the casing has a first inclination downward toward the drain recovery portion, wherein the lowermost bottom wall of the drain recovery portion has a second inclination downward toward the drain discharge port, and wherein the second inclination is larger than the first inclination.

9. The gas cooler according to claim 2, wherein a height position of an upper end of the drain discharge port is lower than a height position of an upper end of the drain recovery portion.

10. The gas cooler according to claim 2, wherein the drain recovery portion locally protrudes from the casing in appearance.

* * * * *